US005466263A

United States Patent [19]

Herdt et al.

[11] Patent Number: 5,466,263

[45] Date of Patent: Nov. 14, 1995

[54] PROCESS FOR DYEING FUR SKINS WITH OXIDATION DYES

[75] Inventors: Hubert Herdt, Offenbach; Josef Hurt, Hofheim, both of Germany

[73] Assignee: Hoechst Aktiengesellschaft, Frankfurt am Main, Germany

[21] Appl. No.: 271,176

[22] Filed: Jul. 7, 1994

[30] Foreign Application Priority Data

Jul. 10, 1993 [DE] Germany ..... 43 23 123.3

[51] Int. Cl.[6] ..... D06P 3/00; D06P 5/00

[52] U.S. Cl. ..... 8/404; 8/94.1 R; 8/94.14; 8/930

[58] Field of Search ..... 8/404, 94.1 R, 8/94.14, 94.15, 930

[56] References Cited

U.S. PATENT DOCUMENTS

| | | | |
|---|---|---|---|
| 4,379,709 | 4/1983 | Margold | 8/94.15 |
| 4,715,861 | 12/1987 | Lotz et al. | 8/94.15 |
| 4,938,779 | 7/1990 | Friese et al. | 8/94.27 |
| 4,978,361 | 12/1990 | Fuchs et al. | 8/94.27 |

FOREIGN PATENT DOCUMENTS

| | | |
|---|---|---|
| 0019435 | 11/1980 | European Pat. Off. . |
| 0339437 | 11/1989 | European Pat. Off. . |
| 0448948 | 10/1991 | European Pat. Off. . |
| 260897 | 1/1911 | Germany . |
| 936863 | 5/1957 | Germany . |
| 0969728 | 11/1982 | U.S.S.R. . |
| 1240810 | 6/1986 | U.S.S.R. . |
| 1490161 | 6/1989 | U.S.S.R. . |
| 1511278 | 9/1989 | U.S.S.R. . |
| 1542957 | 2/1990 | U.S.S.R. . |
| 2187210 | 9/1987 | United Kingdom . |

OTHER PUBLICATIONS

European Search Report No. 94110399.6, Sep. 23, 1994.

*Primary Examiner*—Paul Lieberman
*Assistant Examiner*—Caroline L. Dusheck
*Attorney, Agent, or Firm*—Connolly and Hutz

[57] ABSTRACT

The invention relates to a process for dyeing fur skins with oxidation dyes following a pretreatment, which comprises pretreating the fur skins with a metal mordant that contains glyoxylic acid.

18 Claims, No Drawings

PROCESS FOR DYEING FUR SKINS WITH OXIDATION DYES

DESCRIPTION

Prior to the actual dyeing with oxidation dyes, the fur skins have to be pretreated in a suitable manner, since it has been found that the hair of the fur skins will otherwise take up the oxidation dyes only unevenly. Hitherto it was customary to start the dyeing operation with a process known as opening-up or killing of the hair. This killing is intended to effect a substantial cleaning of the hair, i.e. remove excess fat and soil, neutralize harmful acids and also open up the hair in a suitable manner. The process of killing is mainly practiced in two different forms:

a) dip-killing and b) brush-killing.

Once the hair has been sufficiently opened up by a killing, the dyeing with oxidation dyes is usually additionally preceded by treating the furs with a mordanting solution. The mordant is intended to make the dyeings more light-, wash-, storage- and sublimation-fast. Moreover, after a preliminary mordant the dyeings are much more intensive and stronger in color. The mordant used comprises metal salts, specifically predominantly chromium and iron salts and in rare cases copper salts.

After the mordant the furs are, if necessary, briefly rinsed, then thoroughly hydroextracted and finally introduced into the dyebath. The above-described procedure was hitherto customary and can be found described in the current technical literature, for example Dr. W. Pense, "Rauchwaren", Handbuch der Gerbereichemie und Lederfabrikation, 3rd volume, part 2, 1955.

Surprisingly, it has been found that a pretreatment of the fur skins with metal mordants that contain glyoxylic acid renders the hitherto customary operation of killing superfluous.

The present invention accordingly provides a process for dyeing fur skins with oxidation dyes following a pretreatment, which comprises pretreating the fur skins with a metal mordant that contains glyoxylic acid.

The mordants used are metal salts, specifically predominantly chromium or iron salts. If a chromium mordant is used, the dichromate concentration is usually between 0.1 and 7 g/l of mordanting liquor, and the pH of the mordant lies within the range between 3 and 5. It has been found that only little dichromate goes on at higher pH values between pH 5 and 7, even if the concentration chosen is comparatively high. If the pH values are lower than 3, this will hatshen the hair. The amount of dichromate to be applied to the hair can thus be regulated by the pH and also by the dichromate concentration. A mild mordanting effect is achieved on the one hand at a dichromate level of 2 to 5 g/l of mordanting liquor when the amount of acid added is low and on the other with a dichromate level of 0.3 to 0.5 g/l of mordanting liquor at a pH from 3.5 to 4. Conversely, a strong mordanting effect is achieved with only 0.5 to 1 g of dichromate per liter of mordanting liquor provided the pH is low. The pH is set using glyoxylic acid, but the addition of other acids, e.g. formic acid, acetic acid or glycolic acid, is conceivable. The glyoxylic acid content per liter of mordanting liquor depends on the desired pH and lies between 1 and 7 g/l of mordanting liquor.

If copper mordants are used, the amount of acid is about 1.5 to 3 g of glyoxylic acid per liter of mordanting liquor. If too little acid is added, uneven dyeings are obtained, but if too much acid is added the dyeing is weaker than if the normal amount of acid is added.

The amount of acid added is important in the case of an iron mordant too. Iron mordants with too little acid tend to oxidize. The baths become cloudy as a result of the formation of yellowish brown basic ferrisulfate and ferrihydroxide and sediment a brown sludge on standing. However, a sufficient amount of an acid, preferably glyoxylic acid, in the mordant can prevent the formation of the sparingly soluble iron compounds. Customarily, the iron mordant will have added to it from 1.5 to 3 g of glyoxylic acid, based on one liter of mordanting liquor.

As well as the aforementioned mordants it is also possible to use mordants that contain combinations of the metal salts with one another. Suitable examples are the copper-iron mordant, the chromium-copper mordant, the iron-chrome alum mordant and the copper-chrome alum mordant.

The mordants used according to the invention, as well as the metal salt or a combination of metal salts and glyoxylic acid, customarily contain a certain amount of degreasing agent. Preferred degreasing agents are fatty alcohol polyglycol ethers with 5–12 EO units, e.g. ®Remolgan CX, ®Genapol UD 050, ®Genapol UD 080 (manufacturer: Hoechst AG).

The hitherto customary addition of strong acids, such as formic acid and/or acetic acid, is not necessary but conceivable. If such acids are used, the ratio of glyoxylic acid to strong acid is customarily 9:1. The industrially customary composition of the metal mordant is as follows:

0.5 g to 3 g of at least one metal salt, preferably potassium dichromate, 1.5 g to 3 g of glyoxylic acid, and 0.5 g to 1 g of degreasing agent, based on one liter of mordanting liquor.

The glyoxylic acid is customarily added to the mordanting liquor in the form of an aqueous solution, preferably 40–50% strength by weight.

The mordanting process is generally carried out in reel becks, paddles or closed vessels (drums). The temperature is advantageously 20° to 40° C., while the duration varies between 3 and 24 hours. After mordanting, the furs are— if necessary—briefly rinsed, then thoroughly hydroextracted and finally introduced into the dyebath. A thorough rinse is never advantageous, since otherwise part of the mordanting salts absorbed is washed off again. The rinsing merely serves to remove excess quantities of metal salts and acids. If the mordants, for example dichromate mordant, are made up with little acid, a rinse can be omitted entirely. It is sufficient in this case to centrifuge the furs thoroughly.

Following mordanting, the fur skins are dyed with oxidation dyes by means of known dyeing methods, for example dip-dyeing or brush-dyeing. Owing to the use of glyoxylic acid in the metal mordant, the process of the invention produces in the dyeing of fur skins with oxidation dyes numerous advantages which are mentioned hereinafter:

better hiding of guard hair is achieved in the dyeing;

the natural shine of the fur hair is enhanced; the amount of dichromate remaining in the metal mordant is appreciably reduced;

harshening of the chrome-tanned leather in dyeings with high use of oxidizing agent, for example black and dark brown dyeings, is substantially prevented;

the leather of chrome-tanned fur skins is at least 30 to 50% better in tensile strength than conventionally chromium-mordanted fur skins;

the depth of shade of the dyed fur skins is distinctly enhanced.

Use examples:

EXAMPLE b 1

Black on mutation mink (mink leather with 0.5% $Cr_2O_3$ content after tanning) Float ratio: 1:20, based on dry weight of furs

| | |
|---|---|
| Killing: | dispensed with |
| Mordant: | 2.0 g/l of potassium dichromate |
| | 1.5 ml/l of glyoxylic acid ( ®Feliderm CS) |
| | 0.5 g/l of degreasing agent ( ®Remolgan CX) |
| | 35° C., leave in bath overnight, centrifuge |
| Dyeing: | 3.0 g/l of fur dye gray ( ®Nako-Grau BK) |
| | 2.0 g/l of fur dye ( ®Nako H) |
| | 2.0 g/l of fur dye yellow ( ®Nako-Gelb 3GA) |
| | 1.0 g/l of fur dye ( ®Nako TEG) |

The oxidizing agent used comprises a total of 8.0 ml of $H_2O_2$ (30% strength by weight)/1 of dyeing liquor. The dyeing is carried out at 35° C. for a total of 6 hours.

Result:

Compared to dyeing with preceding killing and conventional mordanting, complete hiding of guard hair is achieved. The underwool of the fur skins is deep black.

After a conventional dyeing with the same amount of dichromate and the same amount of dye the underwool had a brownish tinge.

This required a redye.

On completion of the mordant the dichromate content was 527 mg/l of mordanting liquor.

The leather side of the fur skins mordanted with glyoxylic acid is incomparably softer and stronger than that of those treated by conventional methods.

COMPARATIVE EXAMPLE 1

Black on mutation mink (mink leather with 0.5% $Cr_2O_3$ content after tanning) Float ratio: 1:20, based on dry weight of furs

| | |
|---|---|
| Killing: | 2.0 g/l of anhydrous sodium carbonate |
| | 2.0 ml/l of ammonia (25% strength by weight) |
| | 0.8 g/l of degreasing agent ( ®Remolgan CX) |
| | 32° C., 2 hours, rinse thoroughly, centrifuge |
| Mordant: | 2.0 g/l of potassium dichromate |
| | 1.0 ml/l of glycolic acid 57% |
| | 35° C., leave in bath overnight, centrifuge |
| Dyeing: | 3.0 g/l of fur dye gray ( ®Nako-Grau BK) |
| | 2.0 g/l of fur dye ( ®Nako H) |
| | 2.0 g/l of fur dye yellow ( ®Nako-Gelb 3GA) |
| | 2.0 g/l of fur dye black ( ®Nako-Schwarz RN) |
| | 1.0 g/l of fur dye ( ®Nako TEG) |

The oxidizing agent used comprises a total of 8.0 ml of $H_2O_2$ (30% strength by weight)/l of dyeing liquor. The dyeing is carried out at 35° C. for a total of 6 hours.

Result:

Guard hair not sufficiently covered, underwool slightly brownish. The dichromate content at the end of the mordant is 1250 mg/l of mordanting liquor.

EXAMPLE 2

Dark brown on blue fox (fox leather with 0.58% $Cr_2O_3$ content after tanning) Float ratio: 1:40, based on dry weight of furs

| | |
|---|---|
| Killing: | Dispensed with |
| Mordant: | 1.0 g/l of potassium dichromate |
| | 1.5 ml/l of glyoxylic acid ( ®Feliderm CS) |
| | 0.5 gll of degreasing agent ( ®Remolgan CX) |
| | 35° C., leave in bath overnight, centrifuge |
| Dyeing: | 2.0 g/l of fur dye brown ( ®Nako-Braun GG) |
| | 1.6 g/l of fur dye gray ( ®Nako-Grau BK) |
| | 1.0 g/l of fur dye brown ( ®Nako-Braun R) |
| | 0.8 g/l of fur dye ( ®Nako H) |

The oxidizing agent used comprises a total of 5.0 ml $H_2O_2$ (30% strength by weight)/l of dyeing liquor. The dyeing is carried out at 35° C. for a total of 3 ½ hours.

Result:

Compared to dyeing with preceding killing and conventional mordanting, complete hiding of guard hair is achieved.

Conventionally, with the same amount of dichromate and the same amount of dye, the dyeing is not deep enough. At the end of the mordant the dichromate content is 11 mg/l of mordanting liquor.

The leather side of the fur skins mordanted with glyoxylic acid is distinctly softer and stronger than that of those treated by conventional methods.

COMPARATIVE EXAMPLE 2

Dark brown on blue fox (fox leather with 0.58% $Cr_2O_3$ content after finishing) Float ratio: 1:40, based on dry weight of furs

| | |
|---|---|
| Killing: | 3.0 g/l of anhydrous sodium carbonate |
| | 3.0 ml/l of ammonia (25% strength by weight) |
| | 0.8 g/l of degreasing agent ( ®Remolgan CX) |
| | 32° C., 2 hours, rinse thoroughly, centrifuge |
| Mordant: | 1.0 g/l of potassium dichromate |
| | 1.5 ml/l of glycolic acid 57% |
| | 35° C., leave in bath overnight, centrifuge |
| Dyeing: | 2.0 g/l of fur dye brown ( ®Nako-Braun GG) |
| | 1.6 g/l of fur dye gray ( ®Nako-Grau BK) |
| | 1.0 g/l of fur dye brown ( ®Nako-Braun R) |
| | 0.8 g/l of fur dye ( ®Nako H) |

The oxidizing agent used comprises a total of 5.0 ml of $H_2O_2$ (30% strength by weight)/l of dyeing liquor. The dyeing is carried out at 35° C. for a total of 3 ½ hours.

Result:

Dyeing too light-colored, guard hair not completely covered.

The dichromate content at the end of the mordant is 478 mg/l of mordanting liquor.

What is claimed is:

1. A process for mordanting fur skins which comprises the steps of:

combining at least one metal salt and glyoxylic acid, to form a mordanting solution wherein the metal salt is an iron salt, a copper salt, a copper-iron salt, a chromium-copper salt, an iron-chrome alum salt, a copper-chrome alum salt, potassium dichromate, sodium dichromate, or mixtures thereof;

bringing said fur skins into contact with said mordanting solution for a time sufficient to effect a mordanting pretreatment of the fur skins with the mordanting solution that contains glyoxylic acid and introducing the fur skins into a dyebath.

2. The process as claimed in claim 1, wherein the mordanting solution contains 0.1 to 7 g of metal salt, based on one liter of mordanting solution.

3. The process as claimed in claim 1, wherein the at least one metal salt is present in an amount of from 0.1 to 7 g, based on one liter of mordanting solution.

4. The process as claimed in claim 1, wherein the mordanting solution additionally contains a degreasing agent.

5. A process as claimed in claim 4, wherein the degreasing agent is a fatty acid polyglycol ether.

6. The process as claimed in claim 1, wherein the pH of the mordanting solution is between 3 and 5.

7. The process as claimed in claim 1, wherein the mordanting solution contains from 1 to 7 g of glyoxylic acid, based on one liter of mordanting solution.

8. The process as claimed in claim 1, wherein the glyoxylic acid is introduced in the form of an aqueous solution.

9. The process as claimed in claim 8, wherein the glyoxylic acid is added to the mordanting solution in the form of a 40–50% by weight aqueous solution.

10. The process as claimed in claim 1, wherein further acids selected from the group consisting of formic acid, acetic acid, glycolic acid or mixtures thereof are added to the mordanting solution.

11. The process as claimed in claim 10, wherein the ratio of glyoxylic acid to further acids is 9:1.

12. The process as claimed in claim 1, wherein the step of bringing the furs into contact with the mordanting solution to effect pretreatment is carried out at a temperature of from 20° to 40° C. and over a duration of from 3 to 24 hours.

13. The process as claimed in claim 1, further comprising the steps of removing the skins from the mordanting solution; then hydroextracting the fur skins.

14. A process as claimed in claim 13, further comprising the step of rinsing the mordanting solution from the fur skins.

15. A process as claimed in claim 14, further comprising the step of introducing the fur skins into a dyebath.

16. A process for producing colorfast dyeings of fur skins, which comprises the steps of:

a) introducing at least one metal salt selected from the group of potassium dichromate, sodium dichromate, or mixtures thereof; glyoxylic acid, and a degreasing agent to form a mordanting solution;

b) bringing said fur skins into contact with said mordanting solution;

c) maintaining said fur skins in contact with said mordanting solution for 3–24 hours at a temperature of from 20° to 40° C.;

d) removing said fur skin from said mordanting solution; and e) introducing said fur skins into a dyebath.

17. A process as claimed in claim 16, further including, between the steps d) and e), a step of rinsing said fur skins.

18. A process as claimed in claim 16, wherein removing the fur skin from the mordanting solution in step d) comprises:

1) draining the mordanting solution form the fur skin, and 2) hydroextracting the mordant solution by centrifugation.

* * * * *